US009280141B2

(12) United States Patent
Parker et al.

(10) Patent No.: US 9,280,141 B2
(45) Date of Patent: Mar. 8, 2016

(54) CONTROLLING TABLE MUSIC SYSTEM

(75) Inventors: Robert Preston Parker, Westborough, MA (US); Todd Charter Brown, Marlborough, MA (US); Edgardo Alicea, Brockton, MA (US); Alex Bradshaw, Framingham, MA (US); Edmundo Garcia, Framingham, MA (US)

(73) Assignee: Bose Corporation, Framingham, MA (US)

( * ) Notice: Subject to any disclaimer, the term of this patent is extended or adjusted under 35 U.S.C. 154(b) by 987 days.

(21) Appl. No.: 13/444,475

(22) Filed: Apr. 11, 2012

(65) Prior Publication Data

US 2013/0273869 A1 Oct. 17, 2013

(51) Int. Cl.

| | |
|---|---|
| ***G04G 13/02*** | (2006.01) |
| ***G04B 47/00*** | (2006.01) |
| ***G04C 21/02*** | (2006.01) |
| ***H04R 1/02*** | (2006.01) |
| ***G04G 17/08*** | (2006.01) |
| ***G04G 21/08*** | (2010.01) |

(52) U.S. Cl.

CPC ..... *G04G 13/02* (2013.01); *G04B 47/00* (2013.01); *G04C 21/02* (2013.01); *G04G 17/086* (2013.01); *G04G 21/08* (2013.01); *H04R 1/02* (2013.01)

(58) Field of Classification Search

CPC ..... H03G 1/02; H03G 3/02; H04R 1/02; H04R 1/06; G04C 21/02; G04G 13/02; G04G 13/021; G04G 13/023; G04G 13/028; G04B 47/00

USPC ..... 455/562.1, 560, 575.7, 436, 446, 428, 455/435.2, 525; 342/372, 373; 381/105, 381/107; 368/10, 74

See application file for complete search history.

(56) References Cited

U.S. PATENT DOCUMENTS

| | | | | | |
|---|---|---|---|---|---|
| 4,246,651 | A | * | 1/1981 | Komatsu et al. | 368/73 |
| 4,304,976 | A | * | 12/1981 | Gottbreht et al. | 219/702 |
| 4,787,040 | A | * | 11/1988 | Ames et al. | 701/1 |
| 5,403,980 | A | | 4/1995 | Eckrich | |
| 5,844,862 | A | * | 12/1998 | Cocatre-Zilgien | 368/10 |

(Continued)

FOREIGN PATENT DOCUMENTS

| | | |
|---|---|---|
| CN | 2060565 U | 8/1990 |
| CN | 2322321 Y | 6/1999 |

(Continued)

OTHER PUBLICATIONS

Bose Wave Music System Owner's Guide. Copyright 1994-2004, and 2009, 32 pages.

(Continued)

*Primary Examiner* — Vit W Miska

(74) *Attorney, Agent, or Firm* — Fish & Richardson P.C.

(57) ABSTRACT

A table music system includes an enclosure having a top surface and a front surface free of manually mechanically actuable controls for controlling functions of the table music system. A radio receiver and powered speakers system are located within the enclosure. A display is located on the front surface of the enclosure for displaying at least time. An alarm in the enclosure is configured to be set by a user to produce an alarm signal at a user-selectable time. A touch-sensitive area on the enclosure allows the user to control a function of the take music system. A wireless remote control permits the user to control functions of the table music system.

25 Claims, 6 Drawing Sheets

(56) References Cited

U.S. PATENT DOCUMENTS

| | | | | |
|---|---|---|---|---|
| 5,917,165 | A * | 6/1999 | Platt et al. | 200/600 |
| 6,667,563 | B2 * | 12/2003 | Bae et al. | 307/112 |
| 6,678,215 | B1 | 1/2004 | Treyz et al. | |
| 7,217,894 | B2 * | 5/2007 | Miyako et al. | 200/61.54 |
| 7,232,973 | B2 * | 6/2007 | Kaps et al. | 200/600 |
| 7,266,049 | B1 | 9/2007 | Suber, III et al. | |
| 7,348,898 | B2 * | 3/2008 | Ono | 341/33 |
| 7,368,693 | B2 * | 5/2008 | Maeda | 219/720 |
| 8,131,386 | B2 * | 3/2012 | Elberbaum | 700/58 |
| 2002/0186618 | A1 | 12/2002 | Kirkpatrick | |
| 2003/0045955 | A1 | 3/2003 | Janik | |
| 2005/0254669 | A1 | 11/2005 | Bose | |
| 2006/0153007 | A1 | 7/2006 | Chester | |
| 2007/0095643 | A1 * | 5/2007 | Weiss et al. | 200/511 |
| 2011/0235469 | A1 | 9/2011 | Irwin | |

FOREIGN PATENT DOCUMENTS

| | | | |
|---|---|---|---|
| CN | 1260664 | A | 7/2000 |
| EP | 1 186 969 | | 3/2002 |
| EP | 1 596 391 | | 11/2005 |
| JP | H02-113119 | U | 1/1992 |
| JP | H05-252568 | A | 9/1993 |
| JP | H06-52293 | A | 2/1994 |
| JP | 6052293 | B | 7/1994 |
| JP | H06-52293 | U | 7/1994 |
| JP | H07-123475 | A | 5/1995 |
| JP | H07-131372 | A | 5/1995 |
| WO | WO 2011/041868 | | 4/2011 |

OTHER PUBLICATIONS

Carlife: "Carrozeria MDS-P7000." carlife.carview.co.jp [online], Dec. 2002 [retrieved on Jun. 21, 2005]. Retrieved from the Internet: <URL: http://carlife.carview.co.jp/UserCartPat.asp?UserCarPatID=10464>, 1 page.

CNET: "Bose Wave Music System (Platinum White)." reviews.cnet.com [online], Oct. 2004 [retrieved on Jun. 21, 2005]. Retrieved from the Internet: <URL: http://reviews.cnet.com/Bose_Wave_Music_System_Platnium_White/4505-7866_7-31127762.html>, 2 pages.

CNET: "iRiver SlimX iMP-550." reviews.cnet.com [online], Sep. 2003 [retrieved on Aug. 30, 2012]. Retrieved from the Internet: <URL: http://reviews.cnet.com/mp3-players/iriver-slimx-imp-550/4505-6490_7-30425798.html>, 3 pages.

CNET: "Bose Wave Radio/CD" www.cent.com.au [online] Jul. 2004 [retrieved on Jun. 21, 2005]. Retrieved from the Internet: <URL: http://www.cnet.com.au/hometheatre/audio/0,39025974,40000218,00.htm>, 2 pages.

minidisc.org: "Pioneer MDS-P7000" www.minidisc.org [online], 2002 [retrieved on Jun. 21, 2005]. Retrieved from the Internet: <URL: http://www.minidisc.org/part_Pioneer_MDS_P700.html>, 1 page.

PCMAG: "Bose Wave Music System." PCMAG.com [online], Apr. 2005 [retrieved on Jun. 21, 2005]. Retrieved from the Internet: <URL: http://www.pcmag.com/article2/0,1759,1785830,00.asp>, 4 pages.

Smith, "SlimDevices Squeezebox." theregister.co.uk [online], Apr. 2004 [retrieved on Jun. 21, 2005]. Retrieved from the Internet: <URL: http://www.theregister.co.uk/2004/04/13/slimdevices_squeezebox/print.html>, 4 pages.

Sondra, "iRiver Slimx iMP-550 CD/ MP3 player with ultraslim design." Amazon.com [online], Jul. 2003 [retrieved on Jun. 21, 2005]. <URL: http://www.amazon.com/exec/obidos/ASIN/B00009YDPM/ref=pd_sxp_f/102-6033841-2473766>, 6 pages.

"SVA HD4208TIII-PDP 42" Flat Panel Plasma EDTV." Amazon.com [online], Oct. 2003 [retrieved on Jun. 21, 2005]. Retrieved from the Internet: <URL: http://www.amazon.com/exec/obidos/ASIN/B0000ULIW/ref=pd_sxp_f/102-6033841-2473766>, 6 pages.

Tobias, "TiVo." andrewtobias.com [online], Feb. 2001 [retrieved on Jun. 21, 2005]. Retrieved from the Internet: <URL: http://www.andrewtobias.com/newcolumns/010201.html>, 2 pages.

"User Manual: iRiver SlimX Multi-Codec CD Player / FM Tuner Model iMP-550." Copyright 1999-2003, 25 pages.

Chinese First Office Action for Application No. 200510070446.2, mailed Sep. 26, 2008, 2 pages.

Chinese Second Office Action for Application No. 200510070446.2, mailed Mar. 13, 2009, 2 pages.

Chinese Reexamination Notification in Application No. 200510070446.2, dated Sep. 14, 2010, 14 pages.

European Search Report for Application No. 05103721.6, completed Aug. 2, 2005, 3 pages.

European Office Action for Application No. 05103721.6, dated Jun. 2, 2006, 3 pages.

European Office Action for Application No. 05103721.6, dated Oct. 26, 2007, 4 pages.

Japanese Office Action for Application No. 2005-139160, mailed May 18, 2010, 6 pages.

Japanese Office Action for Application No. 2005-139160, mailed Jan. 25, 2011, 4 pages.

Japanese Office Action for Application No. 2005-139160, mailed Mar. 6, 2012, 3 pages.

Bose Wave Music System; CNET Reviews; XP-002332810; Jun. 21, 2005; 2 pp.

Bose Wave Music System; PC Magazine; XP-002332811; Jun. 21, 2005; 4 pp.

International Search Report; PCT/US2013/035795; Jul. 4, 2013; 7 pp.

International Search Report and Written Opinion; PCT/US2013/035795; Aug. 22, 2013; pp. 17.

International Preliminary Report on Patentability mailed Oct. 23, 2014 in international application No. PCT/US2013/035795, 12 pgs.

* cited by examiner

CONTROLLING TABLE MUSIC SYSTEM

The present disclosure relates in general to controlling a table music system and more particularly concerns a table music system including a clock radio and a touch-sensitive pad but no manually-operated, mechanically-actuated controls visible on prominent visual surfaces (e.g., the top and front surfaces of the system).

BACKGROUND OF THE INVENTION

For background reference is made to published application U.S. 2005/0254669 A1 entitled REMOTELY CONTROLLING SOUND SYSTEM IN ENCLOSURE published Nov. 17, 2005, the full disclosure incorporated by reference herein, and U.S. Pat. No. 5,403,980 for TOUCH SENSITIVE SWITCH PADS dated Apr. 4, 1995.

SUMMARY

According to one example of the invention, a table music system includes an enclosure comprising a top surface, side surfaces and a front surface, wherein the top surface and front surface are free of manually-operated, mechanically-actuated controls for controlling functions of the table music system. A radio receiver is located within the enclosure for receiving radio signals. A powered speaker system is located within the enclosure for reproducing audio signals in response to audio electrical signals, such as from the radio receiver or CD player. A display is located on the front surface of the enclosure for displaying at least time. An alarm is located in the enclosure for producing an alarm signal at a user-selectable time. A wireless remote control has a number of manual controls that permit the user to control functions of the table music system. A touch-sensitive area is located on the enclosure that permits the user to control at least on-off of the table music system.

The touch-sensitive area may be located on the top surface of the enclosure above the display and may activate a snooze function. The table music system may include a visible indicator of where the touch sensitive area is located that may be a removable sticker. The wireless remote control is preferably configured to control all user-controllable functions of the table music system.

The radio receiver includes an AM ferrite loop stick antenna in the enclosure along one side, and the touch-sensitive area includes a conductive strip secured to the underside of the top surface with a logical circuit connected to the conductive pad by an electrode. The conductive pad is of an area and separation from the AM antenna so as to insignificantly reduce the sensitivity of the AM antenna, typically spaced from the AM antenna by about 7.5 inches (19.1 cm) and of an area of about 1.05 square inches (or 675 square millimeters).

The logical circuitry is constructed and arranged to ordinarily allow the user to turn the table music system on and off, and when the alarm signal sounds, to allow the user to initiate a snooze interval with one touch on the touch-sensitive area and turn the alarm signal off with two touches.

Other features, objects and advantages will become apparent from the following detailed description when read in condition with the accompanying drawing in which:

DETAILED DESCRIPTION

Figure 1A:
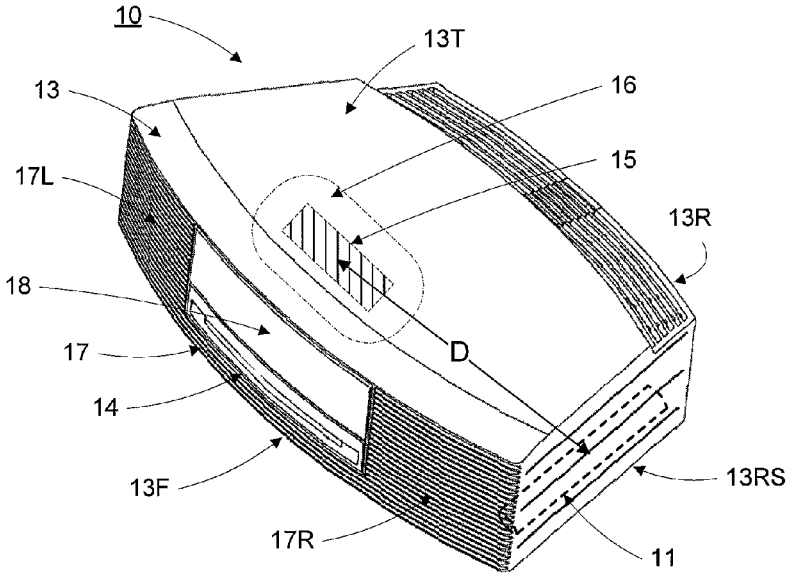
FIG. 1A is a perspective view of a table music system.
Figure 1B:
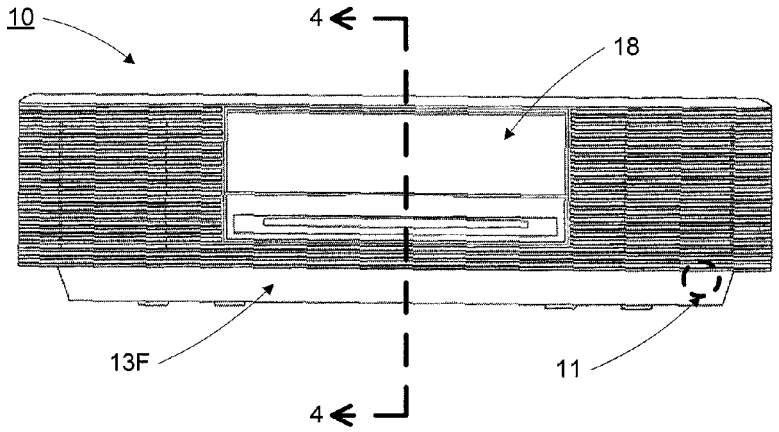
FIGS. 1B-1G are respective front, top, rear, bottom, right and left views of the table music system shown in FIG. 1A.
Figure 1C:
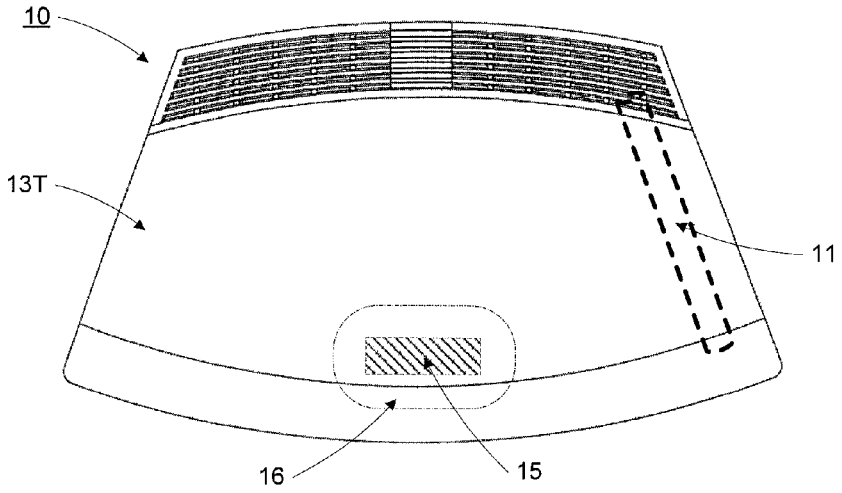
Figure 1D:
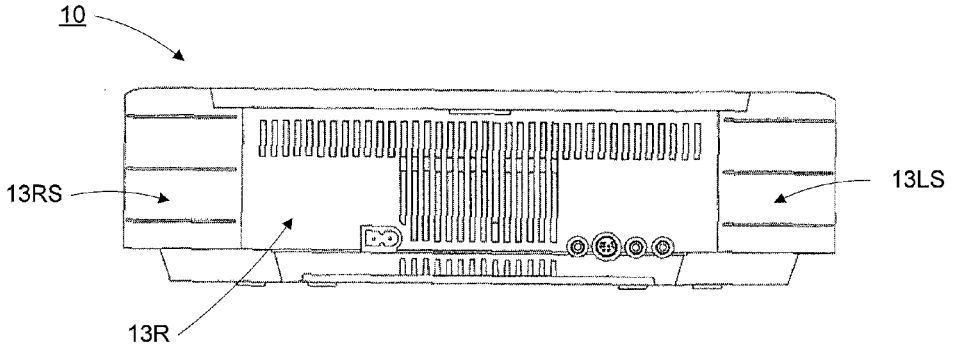
Figure 1E:
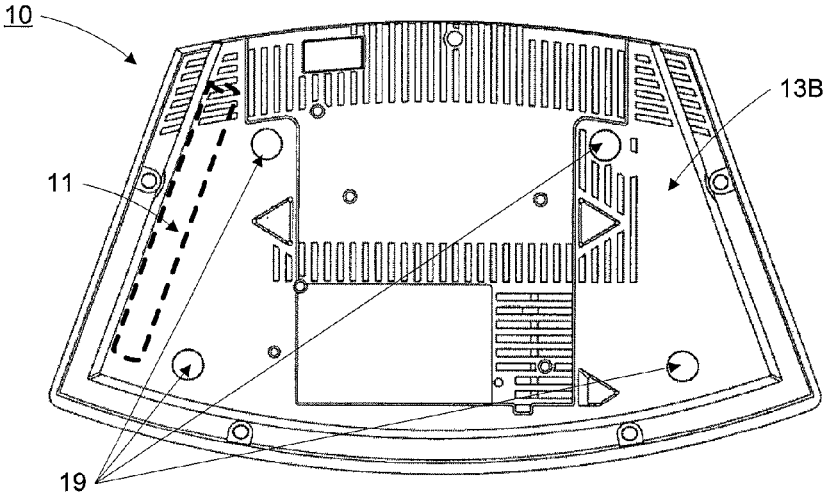
Figure 1F:
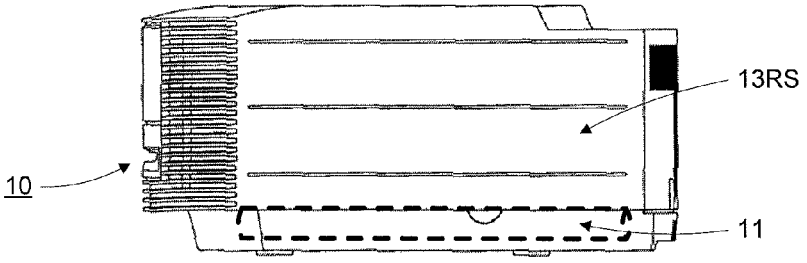
Figure 1G:
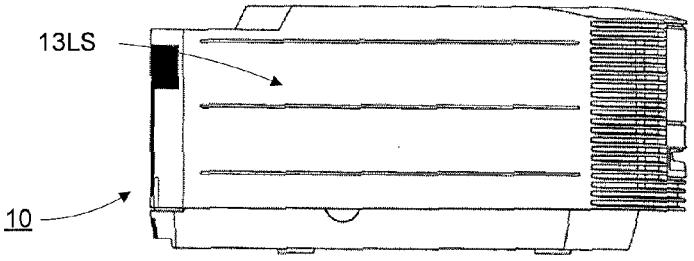

With reference now to the drawings and more particularly FIGS. 1A-1G, there is a shown a table music system 10 with the location of an amplitude modulated (AM) radio antenna 11 indicated by broken lines and the location of a conductive pad 15 indicated by broken lines and cross-hatch. The system 10 includes an enclosure 13 having several prominent visual surfaces from a user's standpoint, namely top surface (13 T), left-side surface (13LS), right-side surface (13RS), and front surface (13F). The system also includes a bottom surface (13B) and rear surface (13R) that are not as visually prominent as the other surfaces from a user standpoint. Note that in this particular example, all of the surfaces of the enclosure 13 are devoid of physical buttons, knobs, sliders, or other manually-operated, mechanically-actuated controls.

The table music system 10 includes an illuminated display 18 that displays a clock and other information associated with the system (e.g., volume level, tuning frequency, audio source selection, alarm setting, etc.). System 10 also includes a slot 14 for loading compact discs (CDs) into a CD-player (not shown), and left and right speakers positioned behind the grille 17 in the areas respectfully labeled 17L and 17R.

Figure 2:
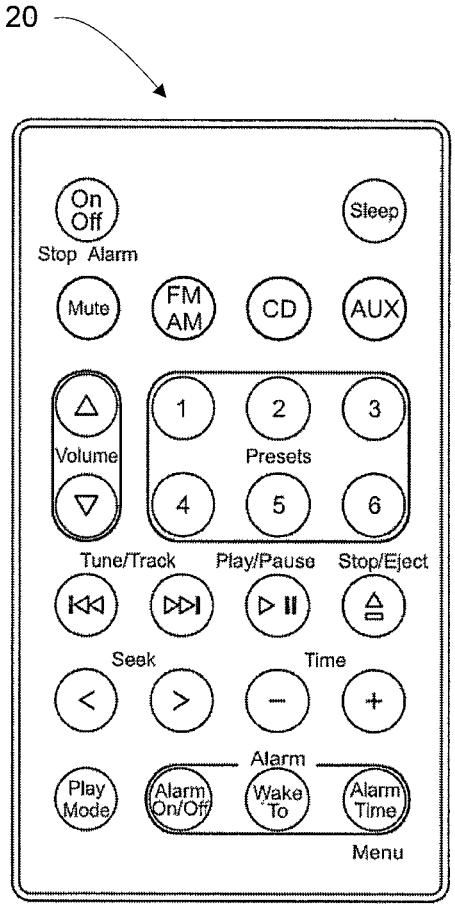
FIG. 2 is a plan view of an associated remote controller.

Referring to FIG. 2, there is shown a plan view of remote control 20 that is configured to operate the table music system 10. Remote control 20 includes a set of buttons configured to provide a user control over the functions of the system. Since there are no manually-operated, mechanically-actuated controls on the enclosure 13 of the system 10, the user primarily controls the system via the remote control 20. The user may use the remote control to perform various user functions provided by the system including: (i) setting the time; (ii) setting the alarm times for a first or second alarm; (iii) setting the audio source for the alarm (e.g., a particular CD track, a particular radio station, a buzzer, etc.); (iii) turning the volume up, down or muting; (iv) selecting an audio source (e.g., AM radio, FM radio, CD, auxiliary input); (v) controlling the CD audio source (e.g., play, fast forward, fast reverse, next/previous track, pause, stop, eject); (vi) controlling the radio source (AM/FM band selection, tuning up/down; setting and selecting station presets); and (vii) powering the system on and off.

However, the system 10 is provided with a touch sensitive area 16 located on the enclosure 13 just above the conductive pad 12 (shown in FIG. 1A). Including a touch sensitive area 16 on the enclosure maintains a clean, visually-appealing top surface (13T) of the enclosure, while also providing the user control over some user functions. In this particular example, the enclosure 13 does not include any permanent visual indications as to the existence or location of the touch sensitive area 16. A temporary sticker (or other temporary visual indicator) may be included on the system (e.g., on top of the touch sensitive area 15) when it is initially sold to the user to provide a clear, but temporary indication of the location of the touch sensitive area. The user may remove the temporary sticker or other visual indicator if he or she wants to enjoy the system without any visual indication of the location of the touch sensitive area. In other implementations, the enclosure may include a permanent indicator of the location of the touch sensitive area such as markings molded into or printed on the enclosure (e.g., power on/off symbol, lines marking the touch sensitive area) or a discrete touch sensitive pad located on the enclosure.

In the example shown in FIGS. 1A-1G, the touch sensitive area 16 is located on the top surface (13T) of the enclosure centered above the illuminated display 18 (which typically illuminates a clock, even when the system is off) and towards the front surface (13F). By aligning the touch sensitive area with the illuminated display 18, the need for a permanent visual indicator of the touch sensor is lessened since the display provides a visual cue as to the location of the sensor. Using the illuminated display as the visual cue for the location of the touch sensor, a user can easily locate the touch sensitive area in the dark by finding the illuminated display.

Since the conductive pad 15 is conductive, it has a tendency to interfere with radio reception, particularly AM radio reception. Accordingly, the internal AM antenna 11 of system 10 is positioned away from the conductive pad 15 along a bottom periphery of the enclosure 13. In this particular example, the conductive pad has a length of 1.77 inches (45 mm), width of 0.59 inches (15 mm) and an area of 1.05 square inches (675 square millimeters) and the center of the conductive pad and center of the AM radio antenna 11 are separated by a distance of 7.5 inches (19.1 cm). This arrangement has been found to provide a good sized touch sensitive area 16 without significantly interfering with radio reception.

Figure 3:
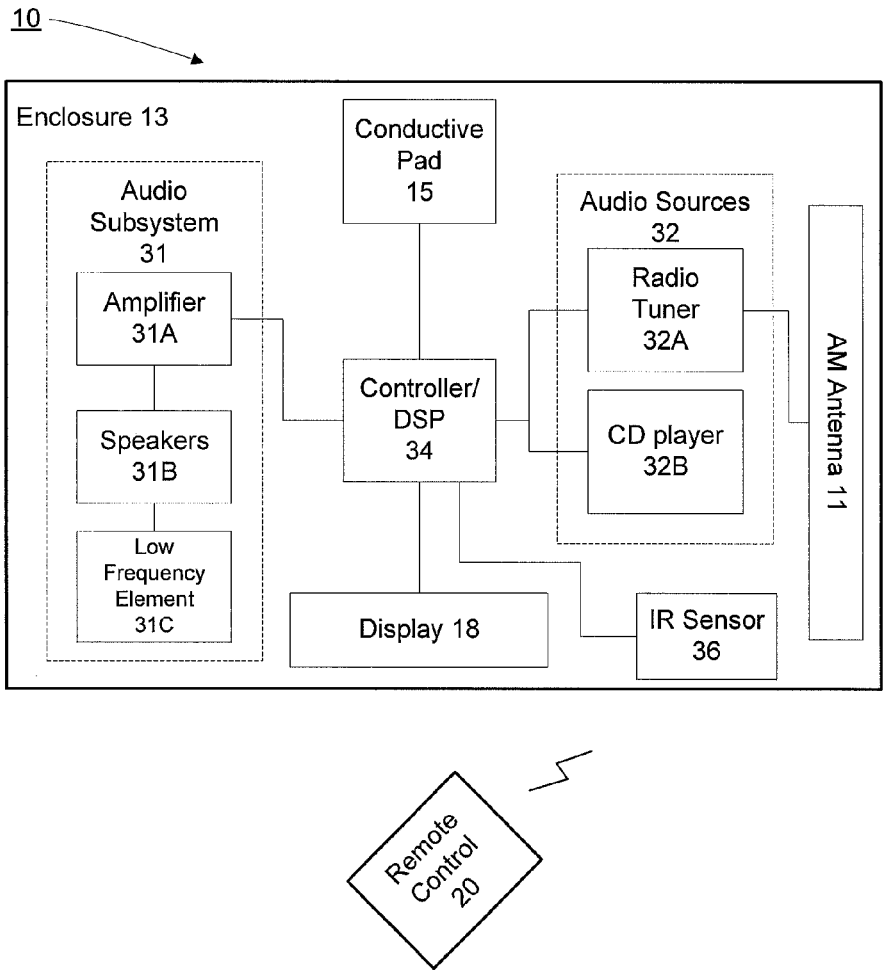
FIG. 3 is a block diagram of the table music system of FIGS. 1A-1G.

Referring to FIG. 3, there is shown a block diagram of the logical arrangement of the table music system 10 shown in FIGS. 1A-1G. As shown, system 10 includes an audio subsystem 31 comprising an amplifier 31A, low frequency element 31L (e.g., an acoustic waveguide, ported box, passive radiators, etc.), and speakers 31S. System 10 also includes audio sources 32 comprising a radio tuner 32A and CD player 32B. AM antenna 11 is connected to radio tuner 32A to receive AM radio signals. The electrical audio signals from radio tuner 32A and CD player 32C are delivered to controller/DSP 34.

Controller/DSP 34 performs audio signal processing (e.g., equalization, dynamic range compression, tone control, spatial processing, etc.) on the audio signals provided by the audio sources 32 delivers the processed signals to the audio subsystem 31. In addition, controller/DSP controls the functions of the system 10. More specifically, remote control commands issued by a user are received at an infrared (IR) sensor 36 and delivered to the controller/DSP to decode and execute. Controller/DSP 34 also controls what is shown on display 18 (e.g., current time, alarm time, current audio source, volume level, etc). Controller/DSP is also operably connected to the conductive pad 15 located just beneath the top surface of the enclosure 13. The conductive pad 15 is charged with a voltage and when another conductive object (such as a user's finger) is placed near the conductive pad 15 (e.g., in the touch sensitive area marked as 16 in FIG. 1), controller/DSP senses a change in the capacitance of the conductive pad 15. When the controller/DSP senses such a change (thus indicating a user has touched the touch sensitive area 16), the controller/DSP performs the following actions depending on the state of system 10:

| State of system 10 | Type of touch sensed | Action performed |
|---|---|---|
| Off | Any touch sensed | Turns system 10 on to last audio source at last volume level |
| On | Any touch sensed | Saves last audio source and volume level information and turns system 10 off |
| Alarm sounding | Touch sensed that lasts for less than 2.5 second | Snooze (i.e., temporarily stop) alarm for 10 minutes |
| Alarm sounding | Touch sensed and held for 2.5 seconds (or more) | Turns current alarm off and resets alarm for next day |

Controller/DSP may be configured such that it must sense a change in the capacitance of the conductive pad 15 for some small time period (e.g., 0.5 seconds) in order to minimize instances where the system falsely detects a user's touch in the touch sensitive area. In addition, the system 10 may be configured such that a user may be able to disable the touch sensitive area altogether in the even the user does not want an active touch sensor on the device. Disabling of the touch sensor may be accomplished, for example, by pressing a combination of buttons on the remote control 20.

Figure 4:
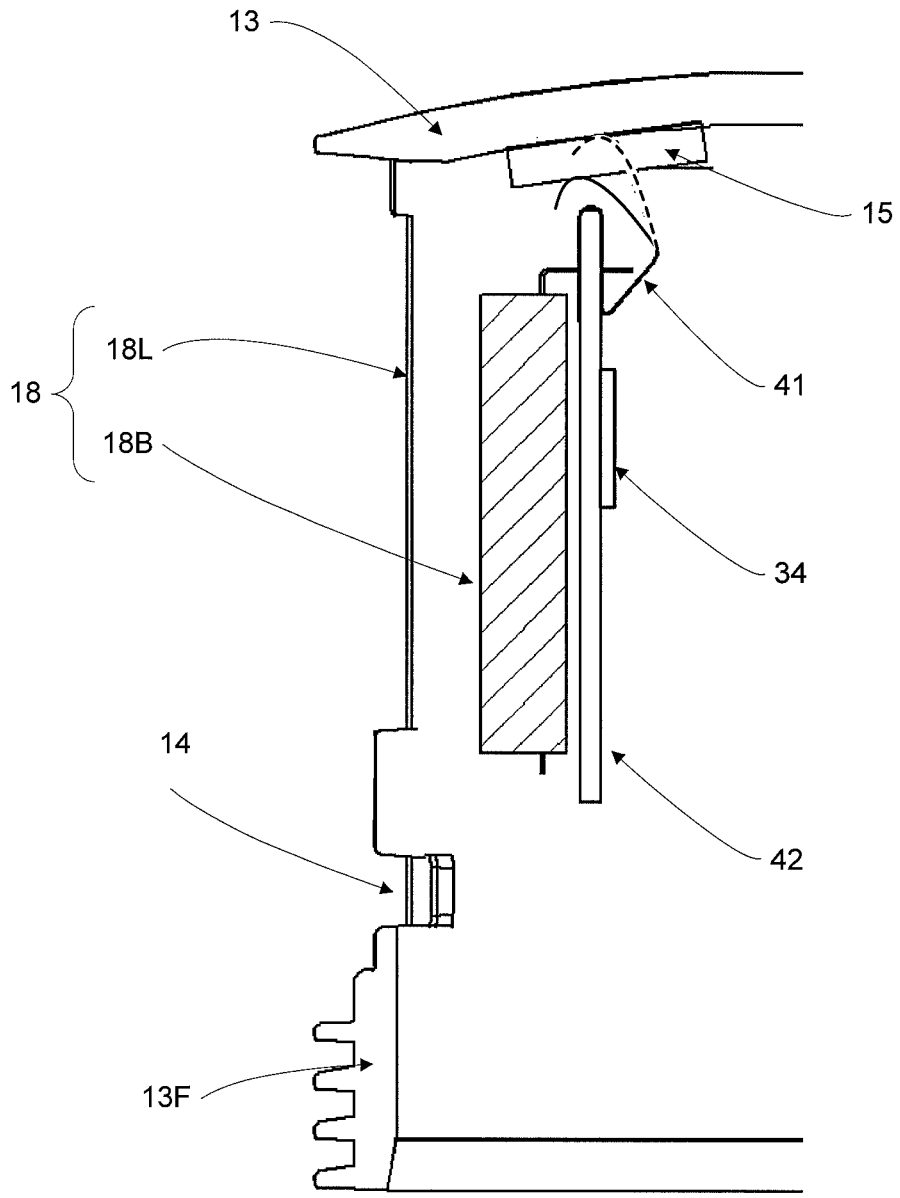
FIG. 4 is a sectional view through section 4-4 of FIG. 1B illustrating the relationship of elements of the touch-sensitive system to the enclosure.

For simplicity, FIG. 3 depicts controller/DSP as a single element, but actual implementations may perform audio signal processing and control functions via separate elements, such as some combination of microprocessors, microcontrollers, or discrete analog components located on one or more circuit boards. In one implementation, the controller for the touch sensor is a separate microcontroller such as touch controller AT42QT1010 manufactured by Atmel Corporation of San Jose, Calif., USA. Referring to FIG. 4, there is shown a view through section 4-4 of FIG. 1 showing of the electrical coupling of the conductive pad 15 to the DSP/controller 34. As shown, the conductive pad 15 is adhered to the underside of the top surface of enclosure 13. The conductive pad may be a piece of felt impregnated with conductive elements (e.g., metal filings). A spring connector 41 electrically couples the conductive pad 15 to a circuit board 42 containing the controller/DSP 34. In this particular example, the enclosure 13 is a two-piece design in which the bottom surface 13B forms one piece of the enclosure and the other surfaces (13T, 13R, 13LS, 13RS) form the other piece of the enclosure and are attached together with screws (via the screw holes 19 shown in FIG. 1E). The circuit board 42 containing the controller/DSP 34, spring connector 41, and display board 18B are mounted to the bottom piece of the enclosure (13B) during manufacture. When the top piece of the enclosure 13 is not present, the spring connector 41 is in a relaxed position (shown by the dotted lines in FIG. 4). The top piece of the enclosure 13 is added during manufacture, the spring connector 41 is compressed (shown by the solid lines in FIG. 4) against the conductive pad 15, thus forming an electrical connection between the conductive pad 15 and circuit board 42. Note that while an electrical connection is formed, a mechanical connection is not. This permits for easy assembly and service of the system 10. In the example shown in FIG. 4, the spring connector 41 is mechanically connected to the circuit board, but not mechanically connected to the conductive pad (only electrically connected to the pad after the two pieces of the enclosure are assembled). However, in other embodiments, the spring connection may be mechanically connected to the conductive pad (not the circuit board), and only electrically connected to the circuit board when the enclosure is assembled.

Also mounted to circuit board 42 is the display board 18B that the controller/DSP controls to provide illuminated visual indicators of various items, such as time, alarm setting, audio source, volume level, etc. The front surface of the enclosure 13F includes a semi-transparent lens 18L that permits transmission of the illuminated portions of the display board 18B to the user while making it difficult for the user to see through to the inside of the enclosure. Together the display board 18B and lens 18L form the illuminated display 18 of the system 10.

The invention has a number of advantages. The user is motivated to listen away from the enclosure for better sound reproduction. When the enclosure is in the bedroom, the user can approach the enclosure to achieve a snooze function, turn the table music system alarm off and the table music system on and off.

It is evident that those skilled in the art may now make numerous uses and modifications of and departures from the specific apparatus and techniques disclosed herein without departing from the inventive concepts. Consequently, the invention is to be construed as to embracing each and every novel feature and a novel combination of features present in or possessed by the apparatus and techniques herein disclosed and limited solely by the spirit and scope of the independent claims.

What is claimed is:

1. A table music system having a clock radio comprising, an enclosure comprising a top surface and a front surface free of manually-operated, mechanically-actuated controls for controlling functions of the table music system, a radio receiver located within the enclosure for receiving radio signals and producing corresponding electrical audio signals, a powered speaker system located within the enclosure for producing audio from the electrical audio signals, a display located on the front surface of the enclosure for displaying at least time, an alarm configured to be set by a user to produce an alarm signal at a user-selectable time, a wireless remote control comprising a plurality of manually operated controls that permit the user to control functions of the table-music system;

a touch-sensitive area located on a surface of the enclosure near a touch sensitive switch inside the enclosure having a conductive strip contacting the surface for controlling at least on-off of the table music system when a user touches the touch sensitive area; and wherein the remote control is configured to permit a user to disable the touch sensitive area.

2. The table music system of claim 1 wherein the touch-sensitive area is located on the top surface of the enclosure.

3. The table music system of claim 2 wherein the touch-sensitive area is located on the top surface of the enclosure above the display.

4. The table music system of claim 1 wherein the touch-sensitive area is constructed and arranged to activate a snooze function.

5. The table music system of claim 1 wherein the touch-sensitive area is constructed and arranged to control a first function when the table music system is in a first state and a second function when the table music system is in a second state.

6. The table music system of claim 5 wherein the touch-sensitive area is constructed and arranged to activate a snooze function when the table music system emits an alarm signal.

7. The table music system of claim 6 wherein the touch-sensitive area is constructed and arranged to turn on the table music system when the table music system is in an off state.

8. The table music system of claim 5 wherein the touch-sensitive area is constructed and arranged to turn off the table music system when the table music system is on.

9. The table music system of claim 1 and further comprising a visible indicator attached to the touch-sensitive area.

10. The table music system of claim 9 wherein the visible indicator is removable by the user.

11. The table music system of claim 10 wherein the visible indicator is a removable sticker.

12. The table music system of claim 1 wherein the wireless remote control is constructed and arranged to control all user-controllable functions of the table music system.

13. The table music system of claim 2 wherein the touch-sensitive area on the enclosure is constructed and arranged to control a subset of the user-controllable functions of the table music system.

14. The table music system of claim 1 wherein the radio receiver includes an AM antenna inside the enclosure adjacent to a side of the enclosure and the touch-sensitive switch includes the conductive strip separated from the AM antenna and of sufficiently small area so that there is negligible interference with the sensitivity of the AM antenna.

15. The table music system in accordance with claim 14 wherein the touch sensitive switch is electrically connected to the conductive strip by a contact.

16. An apparatus comprising:

an enclosure comprising a top surface, bottom surface, front surface, rear surface, left surface, and right surface, wherein at least the front surface is configured to face a user and wherein at least the front and top surfaces are free of manually-operated, mechanically-actuated controls;

an illuminated clock for displaying time through one of the surfaces on the enclosure;

one or more speakers located within the enclosure for reproducing audio;

an alarm configured to be set by a user such that when the time reaches an alarm time, audio is reproduced from the one or more speakers;

a remote control configured to control a plurality of user functions of the apparatus, the plurality of user functions including at least setting a time for the alarm;

a touch sensitive area located on one of the surfaces of the enclosure near a touch sensitive switch inside the enclosure, including a conducting strip on the inside of said one of the surface the touch sensitive area configured to snooze the alarm for a predefined amount of time when the touch sensitive area is touched by a user; and wherein the remote control is configured to permit a user to disable the touch sensitive area.

17. The apparatus of claim 16, wherein the touch sensitive area is configured to shut off the alarm when the touch sensitive area is touched by a user continuously for a predefined amount of time.

18. The apparatus of claim 16, wherein the apparatus further comprises an audio source within the enclosure.

19. The apparatus of claim 18, wherein the audio source comprises a radio receiver.

20. The apparatus of claim 18, wherein the audio source comprises an alarm buzzer.

21. The apparatus of claim 16, wherein all surfaces of the enclosure are free of manually-operated, mechanically-actuated controls.

22. The apparatus of claim 16, wherein the enclosure comprises a plurality of discrete pieces assembled together.

23. A touch sensor for a table music system, the touch sensor comprising:

a conductive pad adhered to the underside of a top surface on a first piece of an enclosure of the table music system;

a controller chip mounted on a circuit board attached to a second piece of an enclosure of the table music system, wherein the controller chip is configured to detect a change in capacitance of the conductive pad indicating a user's touch on the top surface of the enclosure in an area above the conductive pad; and a spring connector having a relaxed position when the first and second piece of the enclosure are not attached and a compressed position when the first and second pieces of the enclosure are attached, wherein the spring connector forms a non-mechanical, electrical connection between the conductive pad and the circuit board.

24. The touch sensor of claim 23 wherein the spring connector is mechanically mounted to the circuit board but not the conductive pad.

25. The touch sensor of claim 23 wherein the spring connector is mechanically mounted to the conductive pad but not the circuit board.

* * * * *